US011732515B2

(12) United States Patent
Vollmer

(10) Patent No.: US 11,732,515 B2
(45) Date of Patent: Aug. 22, 2023

(54) ROTATING FLUSH VEHICLE DOOR HANDLE

(71) Applicant: Atieva, Inc., Newark, CA (US)

(72) Inventor: Axel Boris Vollmer, Sunnyvale, CA (US)

(73) Assignee: Atieva, Inc., Newark, CA (US)

( * ) Notice: Subject to any disclaimer, the term of this patent is extended or adjusted under 35 U.S.C. 154(b) by 66 days.

(21) Appl. No.: 16/811,493

(22) Filed: Mar. 6, 2020

(65) Prior Publication Data

US 2021/0277690 A1 Sep. 9, 2021

(51) Int. Cl.
*E05B 85/10* (2014.01)
*E05B 85/18* (2014.01)

(52) U.S. Cl.
CPC ..... *E05B 85/107* (2013.01); *E05B 85/18* (2013.01)

(58) Field of Classification Search
CPC ..... E05B 85/107; E05B 85/18; E05B 85/103
See application file for complete search history.

(56) References Cited

U.S. PATENT DOCUMENTS 6,923,481 B2 * 8/2005 Bruderick ..... E05B 81/76 292/DIG. 31
7,621,573 B2 * 11/2009 Thomas ..... E05B 85/107 49/501
8,443,553 B1 5/2013 Polewarczyk et al.
9,080,352 B2 * 7/2015 Aerts ..... E05B 85/103
9,593,521 B2 * 3/2017 Breed ..... F02N 11/0807
9,878,691 B2 * 1/2018 Morris ..... B60R 25/245
10,280,658 B2 * 5/2019 Halliwell ..... E05B 85/107
10,294,692 B2 * 5/2019 Smart ..... E05B 85/107
10,301,854 B2 * 5/2019 Christensen ..... E05B 81/76
10,435,926 B2 * 10/2019 Brown ..... E05B 85/16
10,501,967 B2 * 12/2019 Brown ..... E05B 85/103
10,533,353 B2 * 1/2020 Smart ..... E05B 81/76
10,760,307 B2 * 9/2020 Rocci ..... E05B 81/76
10,815,702 B2 * 10/2020 Yoshino ..... E05B 81/76
10,847,998 B2 * 11/2020 Gerardiere ..... E05B 5/00 292/336.3
2004/0223336 A1 * 11/2004 Murakami ..... E05B 17/10 362/501
2008/0163555 A1 * 7/2008 Thomas ..... E05B 85/10 292/336.3

(Continued)

FOREIGN PATENT DOCUMENTS

CN 207469957 U 6/2018
DE 10340792 A1 * 4/2005 ..... E05B 85/107

(Continued)

OTHER PUBLICATIONS

Espacenet, machine translation of WO 2017/125653, generated Dec. 9, 2022. (Year: 2022).*

(Continued)

*Primary Examiner* — Kristina R Fulton
*Assistant Examiner* — Emily G. Brown
(74) *Attorney, Agent, or Firm* — Brake Hughes Bellermann LLP

(57) ABSTRACT

A car door handle that lies flush with the car door exterior surface prior to engagement is provided. Once engaged, the car door handle rotates out and away from the door. After the handle is fully deployed, a grip-through loop is presented to the user, thus simplifying door control.

18 Claims, 4 Drawing Sheets

(56) References Cited

U.S. PATENT DOCUMENTS

| | | | | |
|---|---|---|---|---|
| 2009/0008950 | A1* | 1/2009 | Najima | B60R 5/04 292/336.3 |
| 2009/0039671 | A1* | 2/2009 | Thomas | E05B 81/76 296/146.1 |
| 2012/0013134 | A1* | 1/2012 | Loret de Mola | E05C 1/14 292/164 |
| 2013/0241215 | A1 | 9/2013 | Halliwell et al. | |
| 2015/0069768 | A1* | 3/2015 | Leve | E05B 5/00 292/336.3 |
| 2017/0088099 | A1 | 3/2017 | Ma et al. | |
| 2018/0163442 | A1* | 6/2018 | Soonthornwinate | E05B 79/06 |
| 2018/0171686 | A1* | 6/2018 | Couto Maquieira | E05B 85/107 |
| 2019/0145136 | A1* | 5/2019 | Jung | E05B 83/18 292/336.3 |
| 2020/0325708 | A1* | 10/2020 | Tylla | E05B 85/103 |

FOREIGN PATENT DOCUMENTS

| | | | | | |
|---|---|---|---|---|---|
| DE | 102009022166 | A1 | * | 12/2009 | E05B 81/04 |
| GB | 2574190 | A | * | 12/2019 | E05B 85/107 |
| WO | WO-2017125653 | A1 | * | 7/2017 | E05B 15/0046 |

OTHER PUBLICATIONS

Merriam-Webster.com Dictionary, s.v. "adjacent," accessed Dec. 2, 2022, https://www.merriam-webster.com/dictionary/adjacent. (Year: 2022).*

International Search Report and Written Opinion for PCT Application No. PCT/US2021/070185, dated May 6, 2021, 10 pages.

* cited by examiner

ROTATING FLUSH VEHICLE DOOR HANDLE

FIELD OF THE INVENTION

The present invention relates generally to a vehicle and, more particularly, to an aerodynamic door handle.

BACKGROUND OF THE INVENTION

Conventional vehicles utilize a variety of door handle styles. The most commonly used design is shaped in the form of a loop that extends from the side of the car door, thereby providing the user with an easy means of opening and closing the door. This type of handle may be hinged so that it swings out and away from the door surface, or it may pull directly out and away from the door surface. Alternately, the door handle may be in the form of a lever, typically configured to hinge about the top so that the user pulls the lever upwards, or configured to hinge about the front surface of the lever so that the user pulls the lever out and away from the door. The lever may be designed to allow the user to place multiple fingers under the lever when grabbing the lever, or designed for a single finger to fit under the lever. Alternately, the handle may lie flush with the car surface until required, thereby providing improved aerodynamics. This type of handle may be an electro-mechanical device that extends away from the door surface, or simply a mechanical device that pivots when one end of the handle is depressed.

While there are a many different types and styles of door handles, what is needed is a door handle that provides the aerodynamic benefits of a fully flush door handle with the ease of use and mechanical simplicity of a loop handle. The present invention provides such a car door handle.

SUMMARY OF THE INVENTION

The present invention provides a car door handle integrated into a car door and configured to rotate about an axis, the car door handle including (i) a front handle face, where the front handle face is flush with the exterior door surface when the handle is in the retracted position; (ii) a grip-through loop integrated within and integral to the car door handle, where the grip-through loop is hidden from view when the door handle is in the retracted position and visible and graspable when the door handle is in the deployed position, and where the handle rotates about the axis to move between the retracted and deployed positions; (iii) a deployment system coupled to the car door handle and configured to rotate the handle from the retracted position to the deployed position; and (iv) a retraction system coupled to the car door handle and configured to rotate the car door handle from the deployed position to the retracted position. Preferably the front handle face presents to the viewer as a continuous, curvilinear loop when the car door handle is in the retracted position.

In one aspect, a door unlatching mechanism is coupled to the car door handle and configured to unlatch the car door. The unlatching mechanism may be mechanically coupled to the door handle and configured to unlatch the door when the door handle is rotated about the axis past the deployed position. Alternately, the unlatching mechanism may be an electro-mechanical mechanism and configured to unlatch the door when the door handle is deployed and a door switch is activated. Exemplary door switches include (i) a micro-switch integrated into the door handle, and (ii) a touch-sensitive switch integrated into the door handle.

In another aspect, the deployment system rotates the car door handle from the retracted position to the deployed position in response to (i) activation of a touch-sensitive switch integrated into the car door handle, (ii) depression of a micro-switch integrated into the car door handle, (iii) depression of a micro-switch integrated into the exterior door surface, (iv) depression of a micro-switch integrated into a key fob, and/or (v) activation of a proximity sensor utilizing RFID technology.

In another aspect, the retraction system rotates the car door handle from the deployed position to the retracted position after a preset period of time has passed since deployment of the car door handle.

In another aspect, the system may further include a door position sensor, where the retraction system rotates the car door handle from the deployed position to the retracted position after the door position sensor detects completion of an open-close door sequence since deployment of the car door handle.

In another aspect, the retraction system rotates the car door handle from the deployed position to the retracted position in response to (i) depression of a micro-switch integrated into at least one of a car door handle surface, a door surface, and a key fob; and/or (ii) de-activation of a proximity sensor utilizing RFID technology.

In another aspect, the system may further include an over-ride system configured to prevent the retraction system from rotating the car door handle from the deployed position to the retracted position when a user is engaged with the handle's grip-through loop.

A further understanding of the nature and advantages of the present invention may be realized by reference to the remaining portions of the specification and the drawings.

BRIEF DESCRIPTION OF THE DRAWINGS

It should be understood that the accompanying figures are only meant to illustrate, not limit, the scope of the invention and should not be considered to be to scale. Additionally, the same reference label on different figures should be understood to refer to the same component or a component of similar functionality.

DESCRIPTION OF THE SPECIFIC EMBODIMENTS

As used herein, the singular forms "a", "an" and "the" are intended to include the plural forms as well, unless the context clearly indicates otherwise. The terms "comprises", "comprising", "includes", and/or "including", as used herein, specify the presence of stated features, integers, steps, operations, elements, and/or components, but do not preclude the presence or addition of one or more other features, integers, steps, operations, elements, components, and/or groups thereof. As used herein, the term "and/or" and the symbol "/" are meant to include any and all combinations of one or more of the associated listed items. Additionally, while the terms first, second, etc. may be used herein to describe various steps or calculations, these steps or calculations should not be limited by these terms, rather these terms are only used to distinguish one step or calculation from another. For example, a first calculation could be termed a second calculation; similarly a first step could be termed a second step; similarly a first component could be termed a second component, all without departing from the scope of this disclosure.

The present invention provides a car door handle that lies flush with the car door prior to engagement, and then rotates out and away from the door once engaged. Once the handle has fully rotated out and away from the door, a grip-through loop is presented to the user. The handle can be painted to match the door panel, thereby minimizing its appearance and allowing it to blend into the car exterior, or it can be painted or otherwise treated so that it stands out as a design feature.

FIGS. 1A-1D provide perspective views of a car handle 101 in accordance with the invention. As illustrated, handle 101 is hinged in such a manner that it rotates about an axis during deployment and retraction. In FIGS. 1A-1D, car handle 101 is shown in four different stages of rotation. It should be understood that in operation the handle moves smoothly from the flush, retracted position to the fully deployed position and that the four stages of rotation shown in FIGS. 1A-1D are for illustrative purposes only.

Figure 1A:
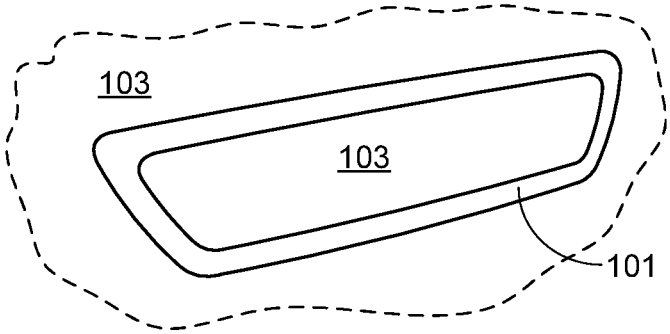
FIGS. 1A-1D provide perspective views of a door handle in accordance with the invention as the door handle moves from the fully retracted position to the fully deployed position.
Figure 1B:
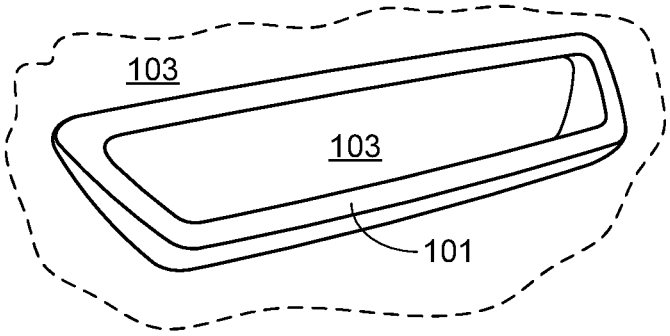
Figure 1C:
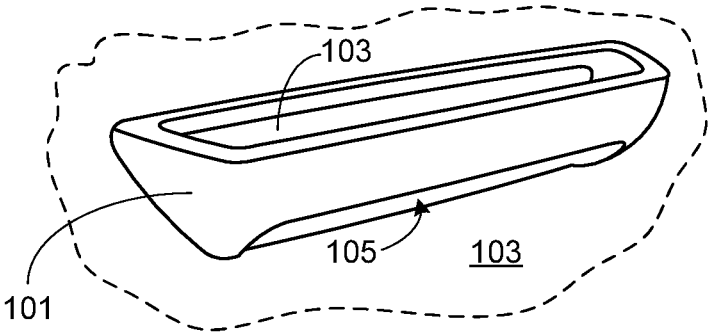
Figure 1D:
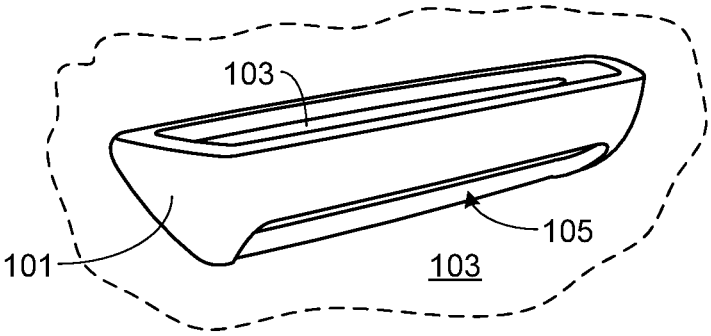
Figure 2A:
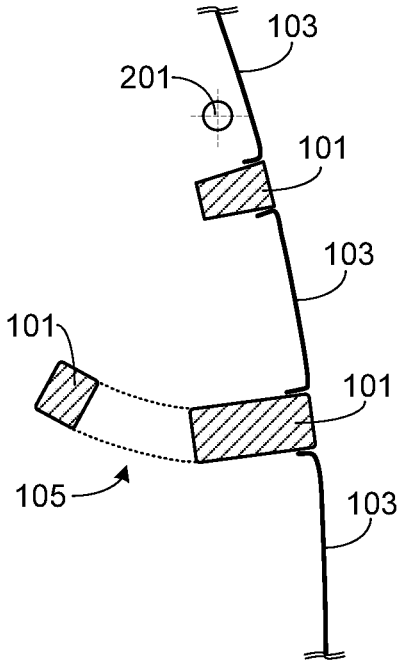
FIGS. 2A-2D provide cross-sectional door handle views corresponding to the perspective views shown in FIGS. 1A-1D.
Figure 2B:
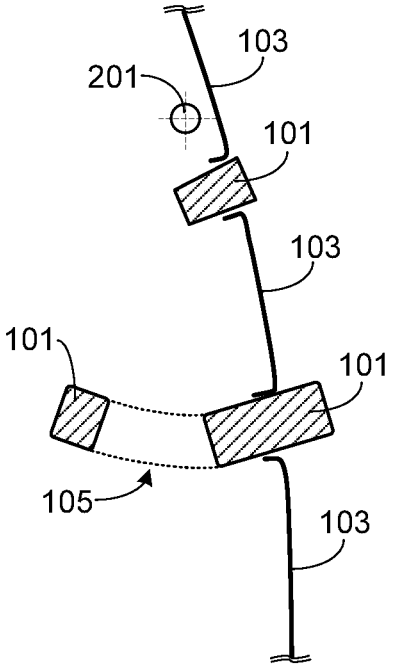
Figure 2C:
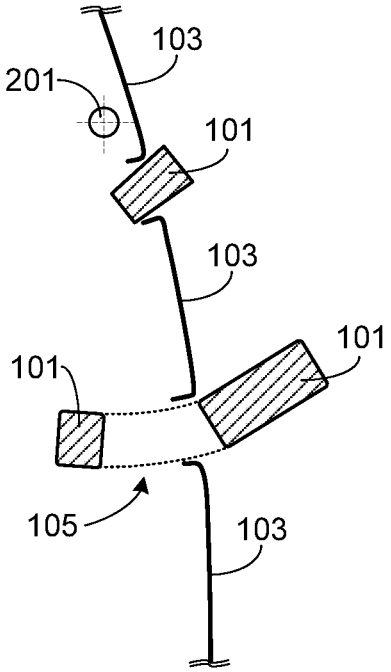
Figure 2D:
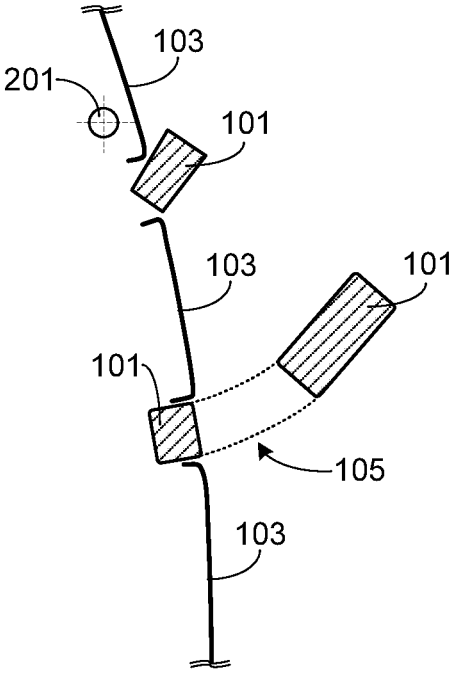

In FIG. 1A car handle 101 is shown in the fully retracted position, the position the handle is in prior to engagement by the user. In the fully retracted position car door handle 101 lies flush with the exterior car door panel 103, thereby minimizing airflow disruption in order to achieve the desired level of aerodynamic performance. In FIGS. 1B and 1C, handle 101 has been activated by the user and is shown rotating out from the car door. In FIG. 1B door handle 101 is approximately 20 percent deployed, while in FIG. 1C the handle is approximately 80-90 percent deployed. In FIG. 1D car handle 101 is fully deployed. When car handle 101 is fully deployed the handle provides a grip-through loop. Grip-through loop 105 is visible in FIGS. 1C and 1D.

FIGS. 2A-2D provide cross-sectional views of car handle 101 that correspond to the perspective views provided by FIGS. 1A-1D. FIGS. 2A-2D clearly illustrate handle 101 moving from the fully flush and retracted position (i.e., FIG. 2A) to the fully deployed position (i.e., FIG. 2D) as it rotates about axis 201.

Figure 3:
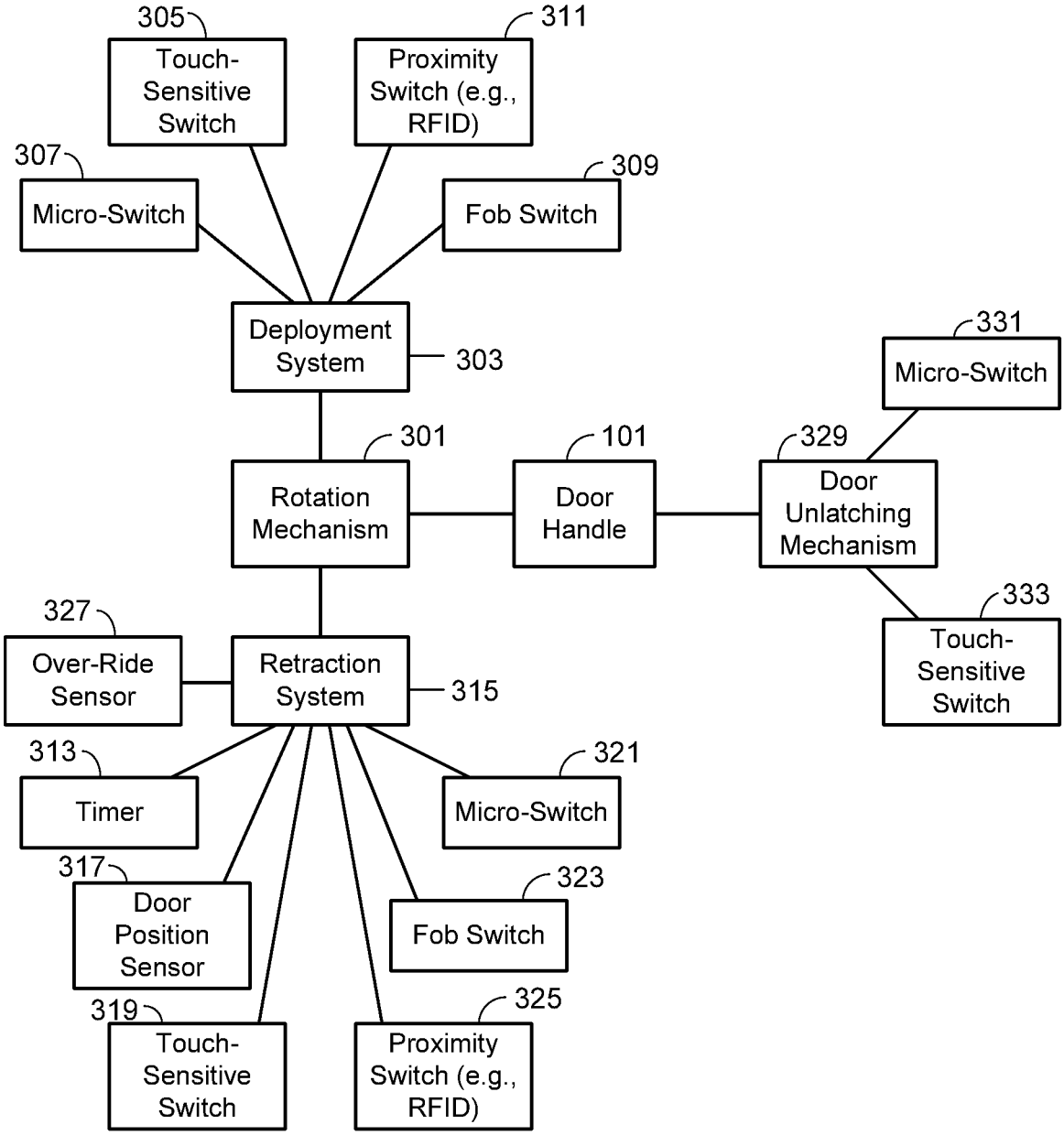
FIG. 3 provides a simplified block diagram of the functional units associated with the car door handle illustrated in FIGS. 1A-1D and 2A-2D.

FIG. 3 provides a simplified block diagram of the functional units associated with car door handle 101. Coupled to handle 101 is the handle rotation mechanism 301. Rotation mechanism 301, which preferably utilizes a small DC motor, rotates door handle 101 about pivot axis 201 during handle deployment and retraction. In order to activate deployment mechanism 301, a deployment system 303 receives a signal from the user, the signal indicating the user's desire to have the door handle deployed. Various devices and means may be used to transmit the signal to system 303. For example, coupled to the surface of handle 101 may be a touch sensitive switch such as a capacitive switch 305. Alternately, capacitive switch 305 may be embedded in the exterior surface of the door, preferably adjacent to the door handle. Alternately, a micro-switch 307 may be coupled to system 303 and used to activate door handle 101. Micro-switch 307 may be embedded in a portion of handle 101 or embedded in the exterior surface of the door. Alternately, a key fob 309 may include a micro-switch that transmits a signal to system 303 indicating the user's desire to have the door handle deploy/retract. Alternately, a proximity switch 311 may be used to transmit a deployment signal to system 303. Preferably if a proximity switch 311 is used, it includes RFID or similar technology to ensure that the car door handle only deploys for pre-designated users.

A variety of techniques may be used, alone or in combination, to signal the need to retract door handle 101 back into the surface of the car door. For example, a timer 313 can be coupled to retraction system 315, where the timer is initiated when the door handle 101 is first deployed. After a preset time has passed since deployment, timer 313 can be programmed to send a retraction signal to system 315 indicating that the door handle should be retracted. In addition to, or in lieu of, timer 313, retraction system 315 can be coupled to a door position sensor 317. Sensor 317 detects if the car door is open or closed and, more preferably, detects when the car door has undergone an open and close sequence. If the open and close sequence occurs immediately after door handle 101 has been deployed, then sensor 317 transmits a close handle command to system 315. In addition to timer 313 and door position sensor 317, it will be appreciated that the techniques used to deploy the door handle can also be used to retract the door handle. For example, a capacitive switch 319, a micro-switch 321, or a key fob switch 323 can be used to send a 'retract handle' command to retraction system 315. If the car uses a proximity switch to deploy the handle, preferably when the same proximity device (e.g., RFID tag 325) moves out of range, the retraction system 315 retracts handle 101.

Regardless of the technique used to transmit a 'close handle' command to retraction system 315, preferably an over-ride sensor 327 is coupled to retraction system 315 to ensure that a user is not accidently injured (i.e., a finger pinch) by an early or inadvertent door handle closure. Sensor 327 determines whether or not the handle is currently in use, for example using a capacitive sensor or other means to detect use. If over-ride sensor 327 determines that the handle is in use, it over-rides the 'retract handle' signal sent to retraction system 315.

Door handle 101 is coupled to a door unlatching mechanism 329. In one embodiment, door unlatching mechanism 329 is a mechanical mechanism that is mechanically coupled to door handle 101. After the door handle is fully deployed, the user is able to lift or pull handle 101, using grip-through loop 105, thereby mechanically unlatching the door. In an alternate embodiment, door unlatching mechanism 329 is an electro-mechanical mechanism. In this embodiment, after door handle 101 is deployed the user depresses a micro-switch 331 or touches a touch-sensitive switch 333 (e.g., a capacitive switch) integrated into door handle 101, preferably integrated into the rear surface of the grip-through loop 105 such that it is invisible when the handle 101 is retracted into the door. Alternately, micro-switch 331 can be coupled to the handle 101 such that the user depresses the switch by lifting or pulling on handle 101 after it is fully deployed. Unlatching mechanism 329 detects the depression of micro-switch 331, or the activation of touch-sensitive switch 333, and unlatches the door.

Systems and methods have been described in general terms as an aid to understanding details of the invention. In some instances, well-known structures, materials, and/or operations have not been specifically shown or described in detail to avoid obscuring aspects of the invention. In other instances, specific details have been given in order to provide a thorough understanding of the invention. One skilled in the relevant art will recognize that the invention may be embodied in other specific forms, for example to adapt to a particular system or apparatus or situation or material or component, without departing from the spirit or essential characteristics thereof. Therefore the disclosures and descriptions herein are intended to be illustrative, but not limiting, of the scope of the invention.

What is claimed is:

1. A vehicle door handle integrated into a vehicle door and configured to rotate about an axis, said vehicle door handle comprising:

a front handle face comprising a first front handle face portion and a second front handle face portion, wherein said first and second front handle face portions of said front handle face are flush with an exterior door surface when said vehicle door handle is in a retracted position, the exterior door surface located on an exterior of the vehicle door and not being involved in retraction or deployment of the vehicle door handle, and wherein said front handle face is visible as a continuous, curvilinear loop when said vehicle door handle is in said retracted position, the continuous, curvilinear loop surrounding a portion of the exterior door surface;

a grip-through loop integrated within and integral to said vehicle door handle, wherein said grip-through loop is hidden from view when said vehicle door handle is in said retracted position, wherein said grip-through loop is visible and graspable when said vehicle door handle is in a deployed position, wherein said vehicle door handle rotates about said axis to move between said retracted position and said deployed position, wherein in the deployed position the first front handle face portion is adjacent the exterior door surface, wherein in the deployed position the second front handle face portion is separated from the exterior door surface by the grip-through loop, and wherein the axis is parallel to a longitudinal extent of the grip-through loop and positioned vertically above the front handle face;

a deployment system coupled to said vehicle door handle, said deployment system configured to rotate said vehicle door handle from said retracted position to said deployed position; and a retraction system coupled to said vehicle door handle, said retraction system configured to rotate said vehicle door handle from said deployed position to said retracted position.

2. The vehicle door handle of claim 1, further comprising a door unlatching mechanism, said door unlatching mechanism configured to unlatch said vehicle door.

3. The vehicle door handle of claim 2, wherein said door unlatching mechanism unlatches said door when said vehicle door handle is rotated about said axis past said deployed position.

4. The vehicle door handle of claim 2, wherein said door unlatching mechanism is an electro-mechanical mechanism configured to unlatch said door when said vehicle door handle is in said deployed position and a door switch is activated.

5. The vehicle door handle of claim 4, wherein said door switch is a micro-switch.

6. The vehicle door handle of claim 4, wherein said door switch is a touch-sensitive switch.

7. The vehicle door handle of claim 1, wherein said retraction system rotates said vehicle door handle from said deployed position to said retracted position after a preset period of time has passed since deployment of said vehicle door handle.

8. A vehicle door handle integrated into a vehicle door and configured to rotate about an axis, said vehicle door handle comprising:

a front handle face comprising a first front handle face portion and a second front handle face portion, wherein said first and second front handle face portions of said front handle face are flush with an exterior door surface when said vehicle door handle is in a retracted position, the exterior door surface located on an exterior of the vehicle door and not being involved in retraction or deployment of the vehicle door handle;

a grip-through loop integrated within and integral to said vehicle door handle, wherein said grip-through loop is hidden from view when said vehicle door handle is in said retracted position, wherein said grip-through loop is visible and graspable when said vehicle door handle is in a deployed position, wherein said vehicle door handle rotates about said axis to move between said retracted position and said deployed position, the axis positioned vertically above the front handle face, and wherein said grip-through loop first becomes visible only at a bottom of the vehicle door handle, adjacent the second front handle face portion and on an opposite side of the front handle face from the axis, when the vehicle door handle moves from said retracted position;

a deployment system coupled to said vehicle door handle, said deployment system configured to rotate said vehicle door handle from said retracted position to said deployed position, wherein said deployment system rotates said vehicle door handle from said retracted position to said deployed position in response to activation of a touch-sensitive switch; and a retraction system coupled to said vehicle door handle, said retraction system configured to rotate said vehicle door handle from said deployed position to said retracted position.

9. A vehicle door handle integrated into a vehicle door and configured to rotate about an axis, said vehicle door handle comprising:

a front handle face comprising a first front handle face portion and a second front handle face portion, wherein said first and second front handle face portions of said front handle face are flush with an exterior door surface when said vehicle door handle is in a retracted position, the exterior door surface located on an exterior of the vehicle door and not being involved in retraction or deployment of the vehicle door handle;

a grip-through loop integrated within and integral to said vehicle door handle, wherein said grip-through loop is hidden from view when said vehicle door handle is in said retracted position, wherein said grip-through loop is visible and graspable when said vehicle door handle is in a deployed position, wherein said vehicle door handle rotates about said axis to move between said retracted position and said deployed position, wherein in the deployed position the first front handle face portion is adjacent the exterior door surface, wherein in the deployed position the second front handle face portion is separated from the exterior door surface by the grip-through loop, and wherein the axis is parallel to a longitudinal extent of the grip-through loop and positioned vertically above the front handle face;

a deployment system coupled to said vehicle door handle, said deployment system configured to rotate said vehicle door handle from said retracted position to said deployed position, wherein said deployment system rotates said vehicle door handle from said retracted position to said deployed position in response to depression of a micro-switch integrated into a key fob; and a retraction system coupled to said vehicle door handle, said retraction system configured to rotate said vehicle door handle from said deployed position to said retracted position.

10. A vehicle door handle integrated into a vehicle door and configured to rotate about an axis, said vehicle door handle comprising:

a front handle face comprising a first front handle face portion and a second front handle face portion, wherein said first and second front handle face portions of said front handle face are flush with an exterior door surface when said vehicle door handle is in a retracted position, the exterior door surface located on an exterior of the vehicle door and not being involved in retraction or deployment of the vehicle door handle;

a grip-through loop integrated within and integral to said vehicle door handle, wherein said grip-through loop is hidden from view when said vehicle door handle is in said retracted position, wherein said grip-through loop is visible and graspable when said vehicle door handle is in a deployed position, wherein said vehicle door handle rotates about said axis to move between said retracted position and said deployed position, the axis positioned vertically above the front handle face, and wherein said grip-through loop first becomes visible only at a bottom of the vehicle door handle, adjacent the second front handle face portion and on an opposite side of the front handle face from the axis, when the vehicle door handle moves from said retracted position;

a deployment system coupled to said vehicle door handle, said deployment system configured to rotate said vehicle door handle from said retracted position to said deployed position, wherein said deployment system rotates said vehicle door handle from said retracted position to said deployed position in response to activation of a proximity sensor utilizing RFID technology; and a retraction system coupled to said vehicle door handle, said retraction system configured to rotate said vehicle door handle from said deployed position to said retracted position.

11. A vehicle door handle integrated into a vehicle door and configured to rotate about an axis, said vehicle door handle comprising:

a front handle face comprising a first front handle face portion and a second front handle face portion, wherein said first and second front handle face portions of said front handle face are flush with an exterior door surface when said vehicle door handle is in a retracted position, the exterior door surface located on an exterior of the vehicle door and not being involved in retraction or deployment of the vehicle door handle;

a grip-through loop integrated within and integral to said vehicle door handle, wherein said grip-through loop is hidden from view when said vehicle door handle is in said retracted position, wherein said grip-through loop is visible and graspable when said vehicle door handle is in a deployed position, wherein said vehicle door handle rotates about said axis to move between said retracted position and said deployed position, wherein in the deployed position the first front handle face portion is adjacent the exterior door surface, wherein in the deployed position the second front handle face portion is separated from the exterior door surface by the grip-through loop, and wherein the axis is parallel to a longitudinal extent of the grip-through loop and positioned vertically above the front handle face;

a deployment system coupled to said vehicle door handle, said deployment system configured to rotate said vehicle door handle from said retracted position to said deployed position;

a retraction system coupled to said vehicle door handle, said retraction system configured to rotate said vehicle door handle from said deployed position to said retracted position; and a door position sensor, wherein said retraction system rotates said vehicle door handle from said deployed position to said retracted position after said door position sensor detects completion of an open-close door sequence since deployment of said vehicle door handle.

12. A vehicle door handle integrated into a vehicle door and configured to rotate about an axis, said vehicle door handle comprising:

a front handle face comprising a first front handle face portion and a second front handle face portion, wherein said first and second front handle face portions of said front handle face are flush with an exterior door surface when said vehicle door handle is in a retracted position, the exterior door surface located on an exterior of the vehicle door and not being involved in retraction or deployment of the vehicle door handle;

a grip-through loop integrated within and integral to said vehicle door handle, wherein said grip-through loop is hidden from view when said vehicle door handle is in said retracted position, wherein said grip-through loop is visible and graspable when said vehicle door handle is in a deployed position, wherein said vehicle door handle rotates about said axis to move between said retracted position and said deployed position, the axis positioned vertically above the front handle face, and wherein said grip-through loop first becomes visible only at a bottom of the vehicle door handle, adjacent the second front handle face portion and on an opposite side of the front handle face from the axis, when the vehicle door handle moves from said retracted position;

a deployment system coupled to said vehicle door handle, said deployment system configured to rotate said vehicle door handle from said retracted position to said deployed position; and a retraction system coupled to said vehicle door handle, said retraction system configured to rotate said vehicle door handle from said deployed position to said retracted position, wherein said retraction system rotates said vehicle door handle from said deployed position to said retracted position in response to deactivation of a proximity sensor utilizing RFID technology.

13. A vehicle door handle integrated into a vehicle door and configured to rotate about an axis, said vehicle door handle comprising:

a front handle face comprising a first front handle face portion and a second front handle face portion, wherein said first and second front handle face portions of said front handle face are flush with an exterior door surface when said vehicle door handle is in a retracted position, the exterior door surface located on an exterior of the vehicle door and not being involved in retraction or deployment of the vehicle door handle;

a grip-through loop integrated within and integral to said vehicle door handle, wherein said grip-through loop is hidden from view when said vehicle door handle is in said retracted position, wherein said grip-through loop is visible and graspable when said vehicle door handle is in a deployed position, wherein said vehicle door handle rotates about said axis to move between said retracted position and said deployed position, wherein in the deployed position the first front handle face portion is adjacent the exterior door surface, wherein in the deployed position the second front handle face portion is separated from the exterior door surface by the grip-through loop, and wherein the axis is parallel to a longitudinal extent of the grip-through loop and positioned vertically above the front handle face;

a deployment system coupled to said vehicle door handle, said deployment system configured to rotate said vehicle door handle from said retracted position to said deployed position;

a retraction system coupled to said vehicle door handle, said retraction system configured to rotate said vehicle door handle from said deployed position to said retracted position; and an over-ride system, said over-ride system configured to prevent said retraction system from rotating said vehicle door handle from said deployed position to said retracted position when a user is engaged with said grip-through loop of said vehicle door handle.

14. A vehicle door handle integrated into a vehicle door and configured to rotate about an axis, said vehicle door handle comprising:

a front handle face comprising a first front handle face portion and a second front handle face portion, wherein said first and second front handle face portions of said front handle face are flush with an exterior door surface when said vehicle door handle is in a retracted position, the exterior door surface located on an exterior of the vehicle door and not being involved in retraction or deployment of the vehicle door handle, wherein the front handle face is visible as a continuous, curvilinear loop when the vehicle door handle is in the retracted position, the continuous, curvilinear loop surrounding a portion of the exterior door surface;

a grip-through loop integrated within and integral to said vehicle door handle, wherein said grip-through loop is hidden from view when said vehicle door handle is in said retracted position, wherein said grip-through loop is visible and graspable when said vehicle door handle is in a deployed position, wherein said vehicle door handle rotates about said axis to move between said retracted position and said deployed position, the axis positioned vertically above the front handle face, and wherein said grip-through loop first becomes visible only at a bottom of the vehicle door handle, adjacent the second front handle face portion and on an opposite side of the front handle face from the axis, when the vehicle door handle moves from said retracted position;

a deployment system coupled to said vehicle door handle, said deployment system configured to rotate said vehicle door handle from said retracted position to said deployed position; and a retraction system coupled to said vehicle door handle, said retraction system configured to rotate said vehicle door handle from said deployed position to said retracted position.

15. The vehicle door handle of claim 14, wherein said deployment system rotates said vehicle door handle from said retracted position to said deployed position in response to depression of a micro-switch.

16. A vehicle door handle integrated into a vehicle door and configured to rotate about an axis, said vehicle door handle comprising:

a front handle face comprising a first front handle face portion and a second front handle face portion, wherein said first and second front handle face portions of said front handle face are flush with an exterior door surface when said vehicle door handle is in a retracted position, the exterior door surface located on an exterior of the vehicle door and not being involved in retraction or deployment of the vehicle door handle, wherein the front handle face is visible as a continuous, curvilinear loop when the vehicle door handle is in the retracted position, the continuous, curvilinear loop surrounding a portion of the exterior door surface;

a grip-through loop integrated within and integral to said vehicle door handle, wherein said grip-through loop is hidden from view when said vehicle door handle is in said retracted position, wherein said grip-through loop is visible and graspable when said vehicle door handle is in a deployed position, wherein said vehicle door handle rotates about said axis to move between said retracted position and said deployed position, wherein in the deployed position the first front handle face portion is adjacent the exterior door surface, wherein in the deployed position the second front handle face portion is separated from the exterior door surface by the grip-through loop, and wherein said axis is located vertically above the vehicle door handle;

a deployment system coupled to said vehicle door handle, said deployment system configured to rotate said vehicle door handle from said retracted position to said deployed position; and a retraction system coupled to said vehicle door handle, said retraction system configured to rotate said vehicle door handle from said deployed position to said retracted position.

17. The vehicle door handle of claim 16, wherein the portion of the exterior door surface does not move when the vehicle door handle rotates about said axis to move between said retracted position and said deployed position.

18. A vehicle door handle integrated into a vehicle door and configured to rotate about an axis, said vehicle door handle comprising:

a front handle face, wherein said front handle face is visible as a continuous, curvilinear loop when the vehicle door handle is in a retracted position, the continuous, curvilinear loop surrounding a portion of an exterior door surface that is located on an exterior of the vehicle door and is not involved in retraction or deployment of the vehicle door handle;

a grip-through loop integrated within and integral to said vehicle door handle, wherein said grip-through loop is hidden from view when said vehicle door handle is in said retracted position, wherein said grip-through loop is visible and graspable when said vehicle door handle is in a deployed position, and wherein said vehicle door handle rotates about said axis to move between said retracted position and said deployed position, the axis positioned vertically above the front handle face;

a deployment system coupled to said vehicle door handle, said deployment system configured to rotate said vehicle door handle from said retracted position to said deployed position; and a retraction system coupled to said vehicle door handle, said retraction system configured to rotate said vehicle door handle from said deployed position to said retracted position.

* * * * *